US006670862B2

(12) United States Patent
Masuda

(10) Patent No.: US 6,670,862 B2
(45) Date of Patent: Dec. 30, 2003

(54) NONRECIPROCAL CIRCUIT DEVICE AND COMMUNICATION APPARATUS

(75) Inventor: Akihito Masuda, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 61 days.

(21) Appl. No.: 09/815,842

(22) Filed: Mar. 22, 2001

(65) Prior Publication Data

US 2001/0045871 A1 Nov. 29, 2001

(30) Foreign Application Priority Data

Mar. 22, 2000 (JP) ..... 2000-080327

(51) Int. Cl.[7] ..... H01P 1/36; H01P 1/32
(52) U.S. Cl. ..... 333/1.1; 333/24.2
(58) Field of Search ..... 333/1.1, 24.2

(56) References Cited

U.S. PATENT DOCUMENTS 4,812,787 A * 3/1989 Kuramoto et al. ..... 333/1.1
4,972,989 A * 11/1990 Black et al. ..... 228/179.1
5,945,887 A * 8/1999 Makino et al. ..... 333/1.1

FOREIGN PATENT DOCUMENTS

EP 0903801 A2 * 3/1999 ..... H01P/1/387
JP 6-077310 10/1994
JP 11-097908 A 4/1999
JP 11-251805 A 9/1999

* cited by examiner

*Primary Examiner*—Robert Pascal
*Assistant Examiner*—Stephen E. Jones
(74) *Attorney, Agent, or Firm*—Keating & Bennett, LLP

(57) ABSTRACT

A nonreciprocal circuit device is provided which prevents the center conductors thereof from interfering with each other when folded toward a magnetic body even when the magnetic body has a rectangle shape in plan view, and which thereby increases the reliability of the bonding portion between the center conductor coupling portion and capacitors or input/output terminals, and a communication device using the same is further provided. A ferrite having a rectangle shape in plan view is placed on the coupling portion of the center conductors, and a magnetic assembly is constructed by folding the center conductors extending from the coupling portion outward so as to wrap the ferrite. At this time, the port portions of the center conductors extending from the coupling portion outward substantially line-symmetrically are formed asymmetrically with each other so as not to mutually interfere when these center conductors are folded toward the magnetic body.

5 Claims, 6 Drawing Sheets

NONRECIPROCAL CIRCUIT DEVICE AND COMMUNICATION APPARATUS

BACKGROUND OF THE INVENTION

1. Field of the Invention

The present invention relates to a nonreciprocal circuit device, such as an isolator used in a high frequency band such as microwave band, and further to a communication apparatus using the same.

2. Description of the Related Art

Hitherto, a lumped-constant type circulator has been constructed by accommodating, within a case, a plurality of center conductors which intersect each other and which are disposed adjacent to a ferrite plate, and a magnet which applies a DC magnetic field to the ferrite plate. Also, an isolator is formed by terminating one predetermined port of the three ports thereof by a resistor.

FIG. 4 is an exploded perspective view illustrating a conventional isolator. Herein, reference numeral 2 designates a box-shaped upper yoke formed of a magnetic metal, and 3 designates a rectangular plate-shaped permanent magnet which is to be disposed on the inner surface of the upper yoke 2. Reference numeral 5 designates a magnetic assembly. The magnetic assembly 5 has a construction wherein a ferrite 54 is disposed on the coupling portion of center conductors, the coupling portion having the same shape as that of the bottom surface of the disk-shaped ferrite 54, wherein three center conductors extending from the coupling portion are folded so as to wrap the ferrite 54 in a state of intersecting one another at an angle of 120°, and wherein the port portions P1, P2, and P3 on the tip sides of the center conductors are projected outward, respectively. Reference numeral 4 denotes a spacer for keeping the gap between the magnetic assembly 5 and the permanent magnet 3 at a predetermined spacing, and 7 denotes a resin case. Matching capacitors C1, C2, and C3 are connected between the respective port portions P1, P2, and P3, and a ground electrode in the resin case 7. A terminating resistor R is connected between the electrode conducting to the port portion P3 and the ground electrode. Reference numeral 8 denotes a lower yoke formed of a magnetic metal, which forms a closed magnetic circuit by being combined with the upper yoke 2.

The conventional isolator shown in FIG. 4 uses a disk-shaped ferrite, and has the structure as shown in FIGS. 5A and 5B in order to dispose the three center conductors adjacent to the ferrite so as to intersect one another with a cross angle of 120°. FIG. 5A is a view showing the center conductors before being folded, that is, a development view thereof. FIG. 5B shows the center conductors which are being folded. Here, the portion indicated by reference numeral 50 is the center conductor coupling portion. From this center conductor coupling portion, the three center conductors 51, 52, and 53 are led out in three directions, and the tip portions thereof define the port portions P1, P2, and P3, respectively. The magnetic assembly 5 shown in FIG. 4 is formed by placing the ferrite 54 on the top surface of the center conductor coupling portion 50, in the configuration shown in FIG. 5A, and by then folding the three center conductors 51, 52 and 53 so as to wrap the ferrite 54, as shown in FIG. 5B.

As a method for bending the center conductor, a method can be adopted wherein the ferrite is abutted against the center conductor coupling portion, and while utilizing this push force, each of the center conductors extending from the center conductor coupling portion in the radial directions is once raised at an angle of about 30 to 70°. This is an effective method when the center conductors are bent by means of an automatic machine.

Meanwhile, the port portions provided at the tips of the center conductors are connected to the input/output terminals or the capacitors. In order to enhance the quality of the bonding portions with the input/output terminals and the capacitors, it is necessary to ensure sufficiently large bonding areas. For this purpose, it is desirable to form the port portion at the tip part of each of the center conductors into a size as large as possible.

In the resin case having a rectangular shape in a plan view as a whole, in order to make the volume of the magnetic body coupled with the center conductors as large as possible, as well as to facilitate the molding of the magnetic body, it is effective to use a magnetic body having a rectangular shape in a plan view (i.e., a magnetic body of a rectangular parallelepiped). FIG. 6 shows the shapes of the center conductors when a magnetic body having a rectangular shape in a plan view is used. In the configuration shown in FIG. 6A, the ferrite 54 is placed on the top surface of the center conductor coupling portion 50, and firstly the center conductor 51 is folded. Then, when attempting to fold the center conductor 52, the port portion P1 at the tip part of the first center conductor 51 can interfere with the second center conductor 52, as indicated by a mark ○ in FIG. 6B, thereby not allowing the second center conductor 52 to be bent. One solution to this problem is to form the port portion at the tip part of one center conductor into a smaller size so as not to interfere with the other center conductor. However, this raises a problem that the bonding areas between the port portions and the capacitors or the input/output terminals cannot be sufficiently ensured, resulting in a reduced reliability of the bonding portions.

SUMMARY OF THE INVENTION

Accordingly, it is an object of the present invention to solve the above-described problem, and to provide a nonreciprocal circuit device which prevents the center conductors thereof from interfering with each other when folded toward a magnetic body even when the magnetic body has a rectangular shape in a plan view, and which thereby increases the reliability of the bonding portions between the port portions at the tip parts of the center conductors and the capacitors or the input/output terminals, and further to provide a communication device using this nonreciprocal circuit device.

In accordance with a first aspect of the present invention, there is provided a nonreciprocal circuit device comprising a plurality of center conductor, a magnetic body placed on the coupling portion of the center conductors, and a magnetic assembly in which the center conductors extending from the coupling portion outward are folded so as to wrap the magnetic body. In this nonreciprocal circuit device, the magnetic body is formed as a rectangular shape, and the port portions of the center conductors which are to be connected to the capacitors or the input/output terminals are formed asymmetrically with each other so as not to mutually interfere when the center conductors are folded toward the magnetic body.

By these structures, the center conductors can be prevented from an interference when they are folded, without the need to reduce the size of the port portion at the tip part of each of the center conductors.

In the first aspect of the present invention, preferably, the port portion of one of the two center conductors which extend from the coupling portion outward substantially line-symmetrically, is formed smaller than the port portion of the other center conductor. In virtue of this structure, when folding the two center conductors so as to wrap the magnetic body, by folding the center conductor having a smaller port portion earlier and folding the other center conductor later, the port portion of the center conductor which has been already bent can be prevented from interfering with the other center portion, and the port portion of the center conductor to be folded later can be provided with a sufficiently large size.

Also, in the first aspect of the present invention, it is preferable that at least one of a notch or a hole be formed in the port portions. This structure increases the area of the solder fillets when the port portions are soldered to the capacitors or the input/output terminals, thereby enhancing the reliability of the bonding portions.

A second aspect of the present invention provides a communication apparatus using the above-described nonreciprocal circuit device.

The above and other objects, features, and advantages of the present invention will be clear from the following detailed description of the preferred embodiments of the invention in conjunction with the accompanying drawings.

BRIEF DESCRIPTION OF THE DRAWINGS

FIGS. 5A and 5B are diagrams illustrating the center conductors used in the conventional isolator, wherein FIG. 5A shows the center conductors before being folded, and FIG. 5B shows the center conductors which are being folded.

DESCRIPTION OF THE PREFERRED EMBODIMENTS

The construction of the isolator in accordance with a first embodiment of the present invention will be described with reference to FIGS. 1 through 3.

Figure 1:
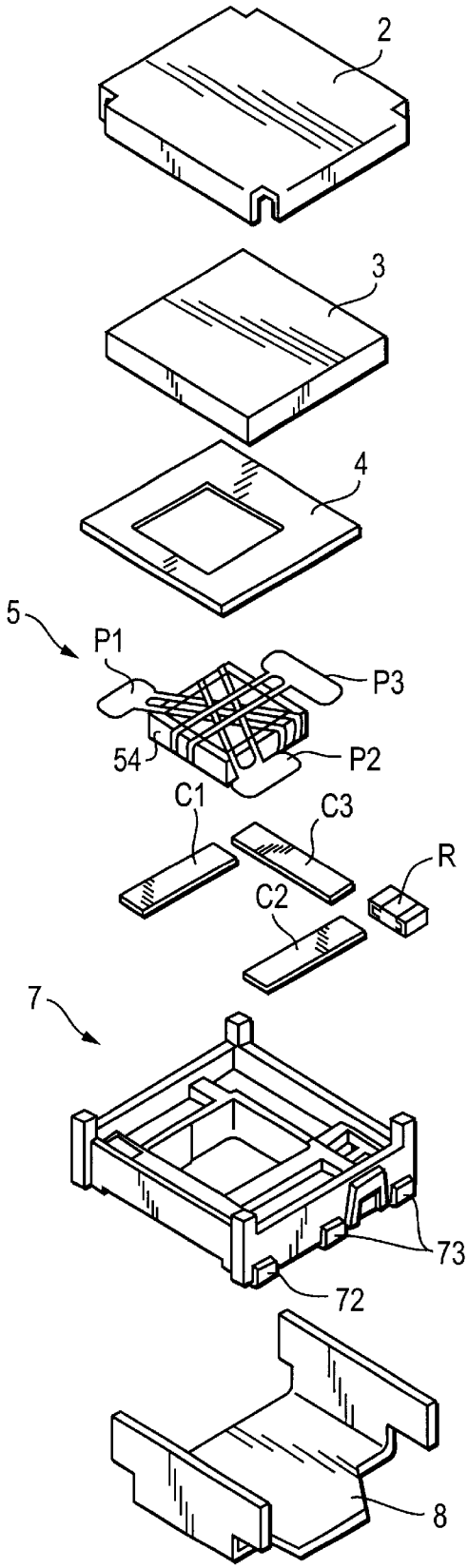
FIG. 1 is an exploded perspective view illustrating an isolator in accordance with an embodiment of the present invention.

FIG. 1 is an exploded perspective view illustrating the isolator. FIG. 2 is a top view illustrating the isolator shown in FIG. 1, the isolator being rid of the upper yoke 2 thereof. The upper yoke 2 is a box-shaped one formed of a magnetic metal. A rectangular plate-shaped permanent magnet 3 is to be disposed on the inner surface of the upper yoke 2. A magnetic assembly 5 has a construction wherein a ferrite 54 is disposed on the coupling portion of center conductors, the coupling portion having substantially the same shape as that of the bottom surface of the disk-shaped ferrite 54, wherein three center conductors 51, 52, and 53 extending from the coupling portion are folded so as to wrap the ferrite 54 with insulating sheets (not shown) interposed therebetween, in a state of intersecting one another at an angle of 120°, and wherein the port portions P1, P2, and P3 on the tip sides of the center conductors 51, 52, and 53 are projected outward, respectively. A spacer 4 is provided for keeping the gap between the magnetic assembly 5 and the permanent magnet 3 at a predetermined spacing. Reference numeral 7 denotes a resin case. A ground electrode, of which one portion is exposed to the top surface of the case, and an input/output terminal 72, a ground terminal 73, etc., which are exposed from the bottom to a side surface of the case, are insert-molded to this resin case 7. Matching capacitors C1, C2, and C3 are connected between the port portions P1, P2, and P3, and the ground electrode in the resin case 7. A terminating resistor R is connected between the electrode conducting to the port portion P3 and the ground electrode. A lower yoke 8 formed of a magnetic metal, which forms a closed magnetic circuit by being combined with the upper yoke 2. The magnetic field by the permanent magnet 3 is applied to the ferrite 54 in the thickness direction thereof.

Figure 3:
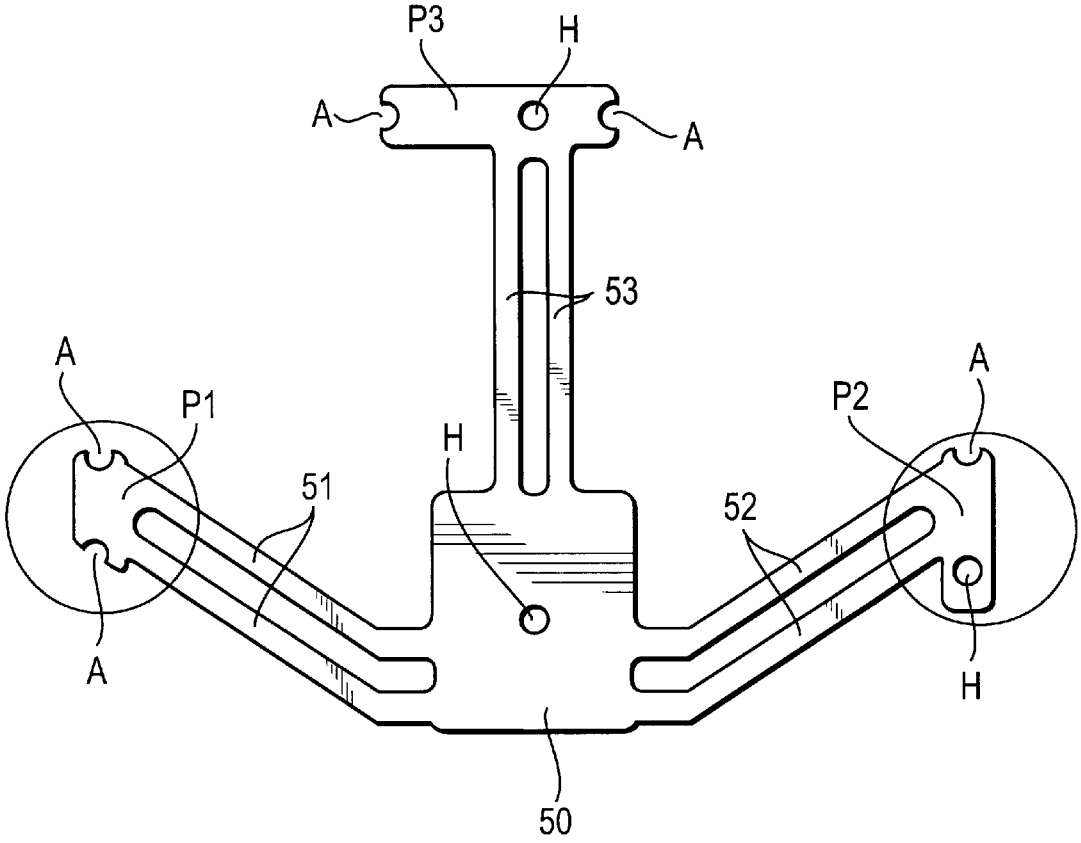
FIG. 3 is a diagram showing center conductors before being folded.
Figure 4:
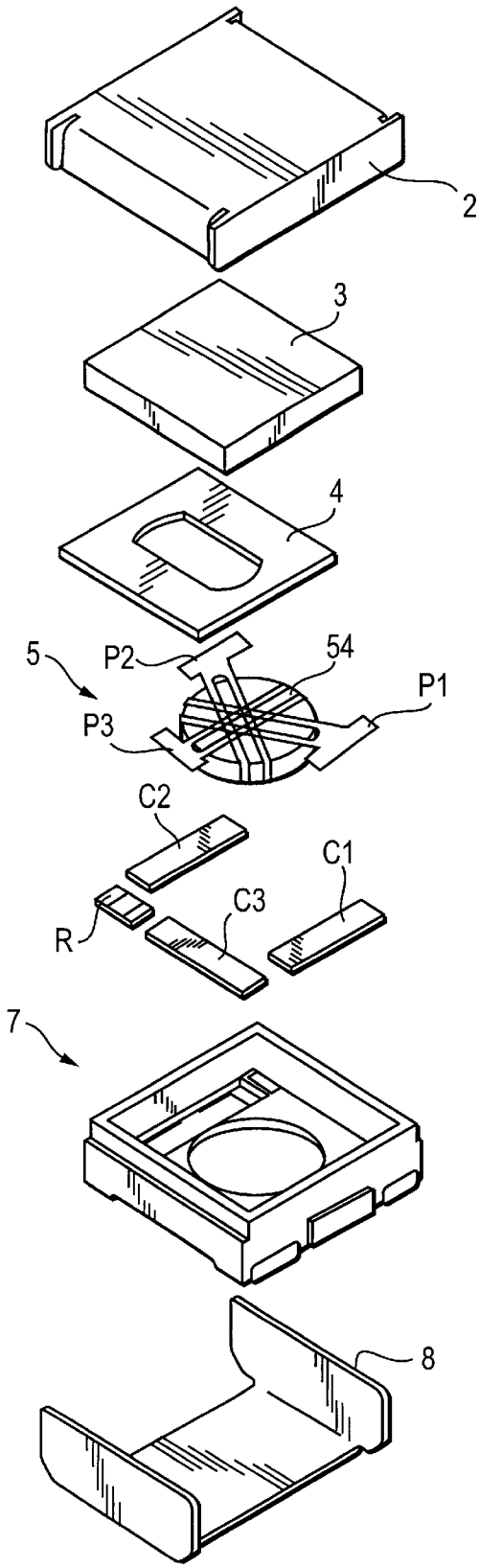
FIG. 4 PRIOR ART
FIG. 4 is an exploded perspective view illustrating a conventional isolator.
Figure 5A:
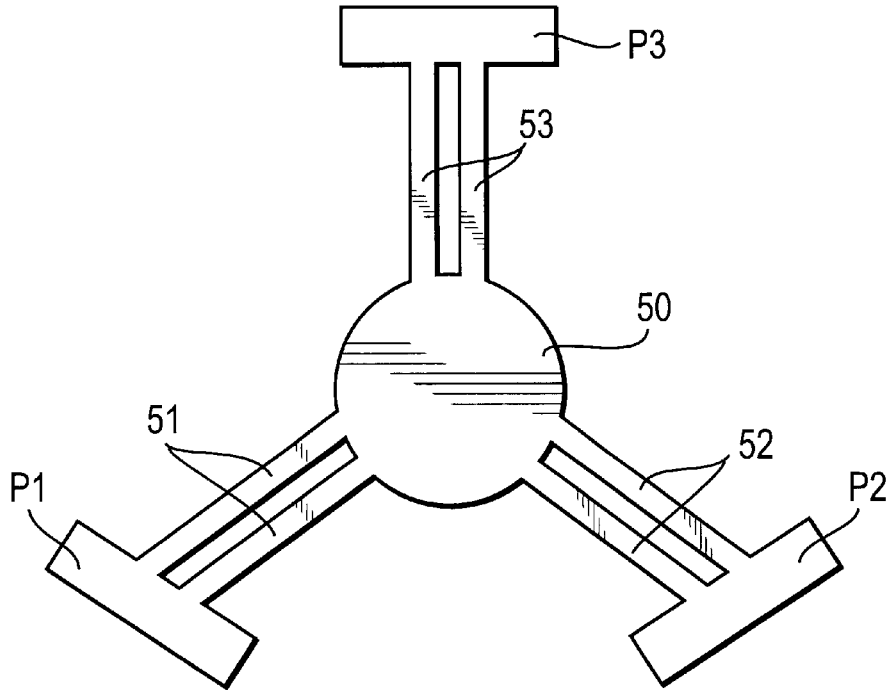
FIG. 5A PRIOR ART
Figure 5B:
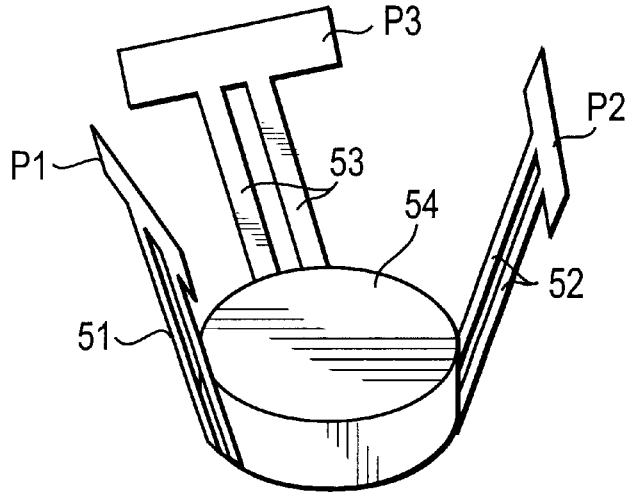
FIG. 5B PRIOR ART
Figure 6A:
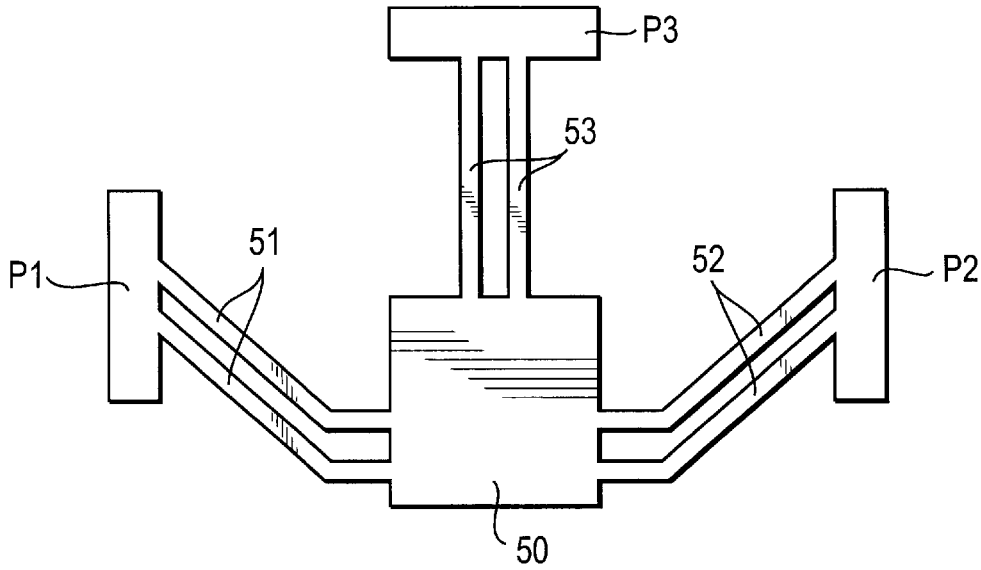
FIG. 6A PRIOR ART
FIG. 6A is a diagram illustrating the shapes of the center conductors in accordance with the conventional art, the center conductors corresponding to a rectangular ferrite.
Figure 6B:
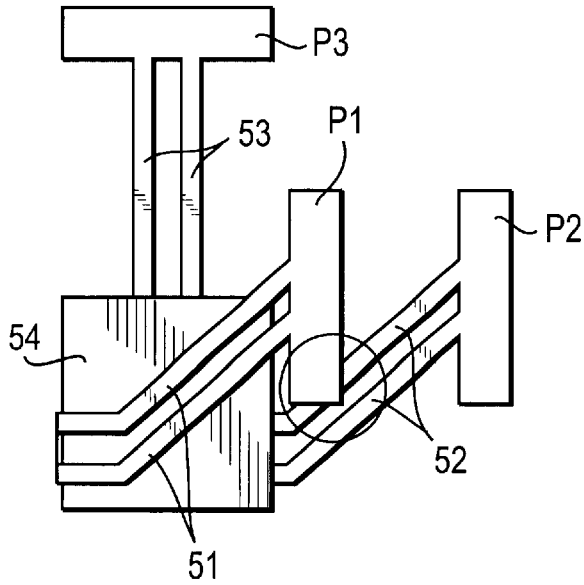
FIG. 6B PRIOR ART
FIG. 6B is a diagram illustrating these center conductors which are being folded.

FIG. 3 is a diagram showing the center conductors before being folded. In FIG. 3, the portion indicated by reference numeral 50 is the coupling portion of the center conductors. On this coupling portion 50, the ferrite 54 is placed. The center conductors 51, 52, and 53 extend from the coupling portion 50 into three directions, and the tip parts of the center conductors 51, 52, and 53 are formed as port portions P1, P2, and P3, respectively. The center conductor 53 among these three center conductors 51, 52, and 53 is led out from the coupling portion 50 along the straight line through the center portion of the coupling portion 50. The other two center conductors 51 and 52 are led out so as to be symmetrical with each other with respect to the line along which the center conductor 53 extends, each forming an angle of 60° with respect to the direction in which the center conductor 53 extends. When the center conductors 51 and 52 which have a line-symmetrical relationship with each other, among the center conductors thus led out in the three directions, are folded, the port of one of these center conductors 51 and 52 can interfere with the other center conductor. However, like this embodiment, by forming the port portion P1 of the center conductor 51 smaller than the port portion P2 of the other center conductor 52, and by folding the center conductor 51 firstly and the center conductor 52 thereafter, the interference of the port portion P1 with respect to the conductor 52 is prevented. The center conductor 53 extending along the symmetry axis with respect to the center conductors 51 and 52 which have a line-symmetrical relationship with each other, does not interfere with the center conductor 51 or 52, irrespective of the point in time when the center conductor 53 is folded, that is, irrespective of its turn to be folded.

Figure 2:
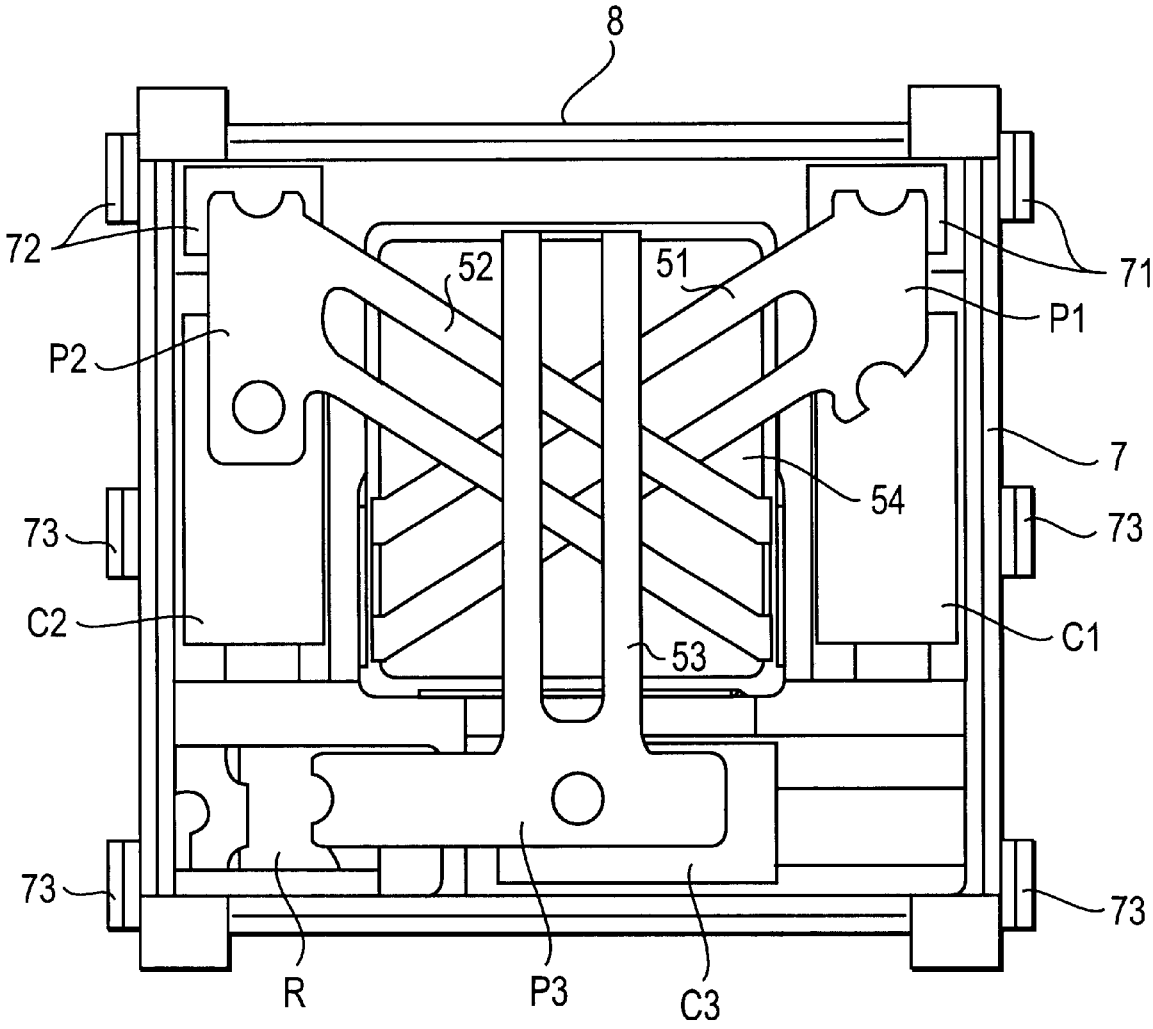
FIG. 2 is a top view illustrating the isolator shown in FIG. 1, the isolator being rid of the upper yoke thereof.

As shown in FIGS. 2 and 3, by providing each of the port portions P1, P2, and P3 with at least one notch A and/or a hole H, it is possible to increase the areas of the solder fillets when soldering the port portions to the electrodes of the top surfaces of the matching capacitors, and to the one electrode of the terminating resistor and the input/output terminals 71 and 72. Thereby, the reliability of the soldered portions can be ensured.

By providing the center portion of the coupling portion 50 of the center conductors with a hole H, a displacement of the ferrite can be prevented by sucking the ferrite from the bottom surface of the hole at the center portion, while the magnetic assembly is performed. This can enhance the assembling accuracy of the magnetic assembly.

In the above-described embodiments, an isolator has been constructed by firstly forming a three-port circulator using the center conductors extended in the three directions, and by then terminating a predetermined port among these three ports by a resistor. However, the present invention can also be applied to the case where a three-port circulator is constructed without terminating one of the ports by a resistor.

Furthermore, the present invention can also be applied to a two-port type isolator wherein two center conductors are led out from the coupling portion of the center conductors in two directions, and wherein the center conductors are folded so as to wrap a magnetic body in a state of intersecting each other. For example, in the embodiment shown in FIG. 3, a two-port type isolator can be achieved by setting the angle formed between the two center conductors to a predetermined angle, and by leading out only the center conductors 51 and 52 from the coupling portion 50.

In the above-described embodiments, the cross angles among the center conductors was set to 120°, but the cross angles in the present invention are not limited to 120°. The cross angles may be changed within the range in which the center conductors do not contact one another, that is, the center conductors are not short-circuited.

Also, the number or positions of the holes and notches formed in the port portions of the center conductors are not restricted to the above-described embodiments, but may be changed as required. Similar effects will be thereby obtained.

As is evident from the foregoing, in accordance with the first aspect of the present invention, the port portions at the tip parts of the center conductors can be prevented from an interference when the center conductors are folded, without the need to reduce the size of the port portion.

Furthermore, in accordance with the first aspect of the present invention, when folding the above-described two center conductors so as to wrap the magnetic body, by folding the one center conductor having a smaller port portion earlier, and folding the other center conductor later, the port portion of the center conductor which has been already bent can be prevented from interfering with the other center conductor, and the port portion of the center conductor to be folded later can be provided with a sufficiently large size.

Moreover, in accordance with the first aspect of the present invention, the area of solder fillets can be increased when the port portions are soldered to the capacitors or the input/output terminals, thereby increasing the reliability of the bonding portions.

In accordance with the second aspect of the present invention, by using the above-described small-sized and high-reliability nonreciprocal circuit device having predetermined nonreciprocal characteristics, a high reliability communication apparatus which has a small size as a whole can be achieved.

While the present invention has been described with reference to what are at present considered to be the preferred embodiments, it is to be understood that various changes and modifications may be made thereto without departing from the invention in its broader aspects and therefore, it is intended that the appended claims cover all such changes and modifications as fall within the true spirit and scope of the invention.

What is claimed is:

1. A nonreciprocal circuit device, comprising:

a plurality of center conductors, each of said plurality of center conductors including a port portion and a coupling portion;

a magnetic body placed on the coupling portion of said center conductors;

a magnetic assembly in which said center conductors extending from said coupling portion outward are folded so as to wrap said magnetic body; wherein said magnetic body has a substantially rectangular shape;

the port portions of said center conductors, which are connected to capacitors or input/output terminals, are formed asymmetrically with each other so as not to mutually interfere when said center conductors are folded toward said magnetic body;

at least one of said port portions includes a hole provided in a central portion thereof; and said coupling portion includes a hole provided therein.

2. A nonreciprocal circuit device in accordance with claim 1, wherein the port portion of one of two center conductors which extend from said coupling portion outward substantially line-symmetrically, is formed smaller than the port portion of the other center conductor.

3. A nonreciprocal circuit device in accordance with claim 1 or 2, wherein a notch is formed on said port portions.

4. A communication apparatus including a nonreciprocal circuit device in accordance with claim 1 or 2.

5. A nonreciprocal circuit device in accordance with claim 1, wherein said hole in said coupling portion is disposed at a center portion of said coupling portion.

* * * * *